US011076233B2

(12) United States Patent
Hiwatari et al.

(10) Patent No.: US 11,076,233 B2
(45) Date of Patent: Jul. 27, 2021

(54) SOUND GENERATION DEVICE

(71) Applicants: Pioneer Corporation, Tokyo (JP); Tohoku Pioneer Corporation, Yamagata (JP)

(72) Inventors: Satoru Hiwatari, Yamagata (JP); Hiroyuki Dohi, Yamagata (JP); Koji Takayama, Yamagata (JP); Hiroyuki Kobayashi, Yamagata (JP)

(73) Assignees: PIONEER CORPORATION, Tokyo (JP); TOHOKU PIONEER CORPORATION, Yamagata (JP)

( * ) Notice: Subject to any disclaimer, the term of this patent is extended or adjusted under 35 U.S.C. 154(b) by 566 days.

(21) Appl. No.: 15/760,330

(22) PCT Filed: Sep. 13, 2016

(86) PCT No.: PCT/JP2016/076917
§ 371 (c)(1),
(2) Date: Mar. 15, 2018

(87) PCT Pub. No.: WO2017/047566
PCT Pub. Date: Mar. 23, 2017

(65) Prior Publication Data

US 2018/0270579 A1 Sep. 20, 2018

(30) Foreign Application Priority Data

Sep. 15, 2015 (JP) ..... JP2015-181969

(51) Int. Cl.
*H04R 7/26* (2006.01)
*H04R 1/02* (2006.01)
(Continued)

(52) U.S. Cl.
CPC ..... *H04R 7/26* (2013.01); *H04R 1/02* (2013.01); *H04R 1/24* (2013.01); *H04R 7/12* (2013.01);
(Continued)

(58) Field of Classification Search
CPC ... H04R 7/26; H04R 7/12; H04R 7/14; H04R 1/02; H04R 1/24; H04R 9/02; H04R 9/025; H04R 2499/10; H04R 2499/13
See application file for complete search history.

(56) References Cited

U.S. PATENT DOCUMENTS 5,143,169 A * 9/1992 Ziegenberg ..... H04R 7/02 181/144
7,845,461 B2 * 12/2010 Imamura ..... H04R 7/125 181/167
(Continued)

FOREIGN PATENT DOCUMENTS

EP 1241916 A2 * 9/2002 ..... H04R 7/26
JP 07-131889 5/1995
(Continued)

OTHER PUBLICATIONS

International Search Report, PCT/JP2016/076917, dated Nov. 29, 2016.

*Primary Examiner* — Forrest M Phillips
(74) *Attorney, Agent, or Firm* — Nixon & Vanderhye

(57) ABSTRACT

Provided is a sound generation device wherein noise can be reduced in accordance with a predetermined frequency band. An elastic member (8) is provided to obtain a sound pressure characteristic having a sub-peak at a predetermined frequency on the lower side than a lowest resonance frequency, and a phase characteristic such that a change rate of phase difference is lowered around the predetermined frequency. When the phase characteristic is calculated by simulation or actually measured in advance and an input
(Continued)

signal is controlled such that the generated sound has an opposite phase to the noise, the generated sound can be made less prone to deviate from the opposite phase to the noise even if a time difference is caused between noise sound collection and sound generation at around the predetermined frequency, with the result that the noise can be effectively reduced. In addition, restrictions regarding the equivalent mass and resonance frequency of a diaphragm (3) can be reduced, the flexibility of design can be improved, and the noise can be reduced in accordance with the predetermined frequency band.

7 Claims, 9 Drawing Sheets

(51) Int. Cl.

| | |
|---|---|
| ***H04R 1/24*** | (2006.01) |
| ***H04R 7/12*** | (2006.01) |
| ***H04R 9/02*** | (2006.01) |
| ***H04R 7/14*** | (2006.01) |

(52) U.S. Cl.
CPC ..... *H04R 9/025* (2013.01); *H04R 7/14* (2013.01); *H04R 9/02* (2013.01); *H04R 2499/10* (2013.01); *H04R 2499/13* (2013.01)

(56) References Cited

U.S. PATENT DOCUMENTS

| | | | | |
|---|---|---|---|---|
| 2012/0106777 | A1* | 5/2012 | Fujimoto | H04R 9/043 381/413 |
| 2016/0080870 | A1* | 3/2016 | Vieites | H04R 7/16 381/398 |
| 2019/0313193 | A1* | 10/2019 | Danovi | H04R 9/06 |

FOREIGN PATENT DOCUMENTS

| | | |
|---|---|---|
| JP | 09-247777 | 9/1997 |
| WO | WO 2012/164866 | 12/2012 |

* cited by examiner

SOUND GENERATION DEVICE

TECHNICAL FIELD

The present invention relates to a sound generation device including a frame, a diaphragm, an edge, and a voice coil.

BACKGROUND ART

Generally, in a speaker device (sound generation device), it is known that a phase difference is generated between an input signal inputted into a magnetic circuit and a generated sound generated by vibrating the diaphragm. Such a speaker device is sometimes used as a noise cancel device. At this time, a sound of opposite phase to the noise is generated for canceling while generating the sound. However, owing to the phase difference as well as a time difference between a sound collection and a sound generation, the generated sound is easy to be shifted from the opposite phase to the noise, and the generated sound and the noise are difficult to cancel each other. Therefore, it is contemplated that a frequency characteristic of the phase difference (phase characteristic) is measured or calculated in advance, and the input signal is controlled such that the generated sound has the opposite phase to the noise. However, because a change rate of the opposite phase is high around a lowest resonance frequency, owing to the time difference, it is difficult to make the noise and the generated sound with phases opposite to each other around the lowest resonance frequency.

On the other hand, a speaker unit aimed at reducing the phase difference between the input signal and the generated sound by adjusting an equivalent mass of the diaphragm and the lowest resonance frequency is proposed (for example, refer to Patent Literature 1). According to the conventional speaker described in the Patent Literature 1, the phase difference is reduced by setting the product of the equivalent mass of the diaphragm and the lowest resonance frequency less than 400 g*Hz, namely, the change rate of the phase difference is also reduced.

CITATION LIST

Patent Literature

Patent Literature 1: JP H09-247777 A

SUMMARY OF INVENTION

Technical Problem

However, in the speaker unit described in the Patent Literature 1, it is necessary to reduce the weight of the diaphragm, and to lower the lowest resonance frequency. Therefore, there are disadvantages that the design flexibility is low, and that only the noise of the specific frequency can be reduced.

Therefore, an object of the present invention is to provide a sound generation device able to reduce a noise in accordance with a predetermined frequency band as one example.

Solution to Problem

For attaining the above object, according to one aspect of the present invention, there is provided a sound generation device including:

a frame;

a diaphragm connected to the frame;

an edge connecting the diaphragm to the frame;

a voice coil directly or indirectly connected to the diaphragm; and an elastic member connected to the diaphragm, wherein a frequency characteristic of a sound pressure of the sound generation device has a sub-peak at a predetermined frequency different from a lowest resonance frequency.

DESCRIPTION OF EMBODIMENT

Figure 1:
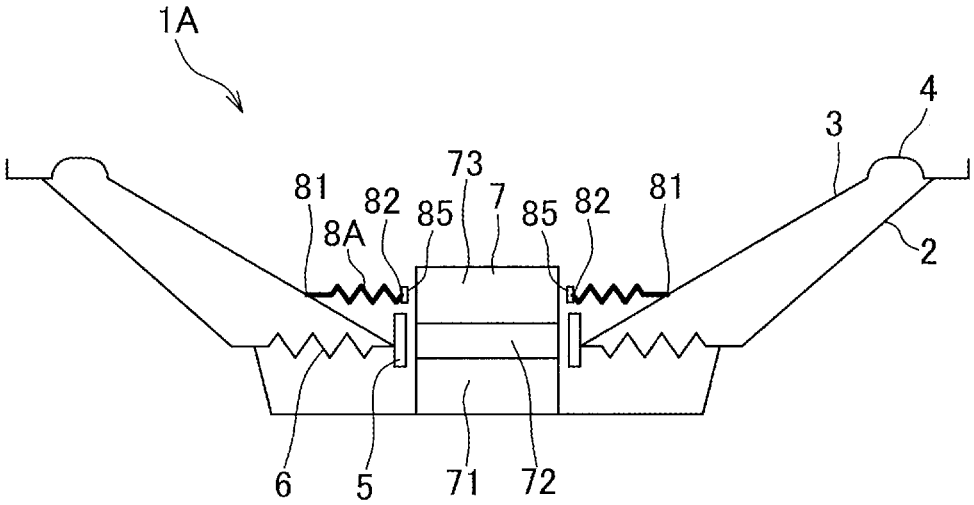
FIG. 1 is a sectional view showing a sound generation device according to an embodiment 1 of the present invention.

Hereinafter, embodiments of the present invention will be explained. A sound generation device according to the embodiments of the present invention includes: a frame; a diaphragm connected to the frame; an edge connecting the diaphragm to the frame; a voice coil directly or indirectly connected to the diaphragm; and an elastic member connected to the diaphragm. A frequency characteristic of a sound pressure of the sound generation device has a sub-peak at a predetermined frequency different from a lowest resonance frequency.

The sound pressure of the generated sound by the sound generation device is lowered as the sound moves from the lowest resonance frequency toward a low band. When the elastic member is provided, and the frequency characteristic of the sound pressure of the sound generation device has the sub-peak at a predetermined frequency different from the lowest resonance frequency, a sound pressure change with respect to the frequency becomes slow around the predetermined frequency (namely, the change rate becomes low). Owing to such a frequency characteristic of the sound pressure (sound pressure characteristic), in the frequency characteristic of the phase difference between the input signal and the generated sound (phase characteristic), the change rate of the phase difference also becomes low around the predetermined frequency. Thereby, when the phase characteristic is calculated or measured in advance and an input signal is controlled such that the generated sound has an opposite phase to the collected noise, the generated sound can be made less prone to deviate from the opposite phase to the noise even if a time difference is caused between noise sound collection and sound generation at around the predetermined frequency, with the result that the noise can be effectively reduced. In addition, restrictions regarding the equivalent mass and resonance frequency of a diaphragm can be reduced, the design flexibility can be improved, and the noise can be reduced in accordance with the predetermined frequency band.

Incidentally, the sub-peak means a peak (hill) formed at a predetermined frequency different from the lowest resonance frequency in the sound pressure characteristic, and in the sub-peak, the sound pressure may be local maximum.

The elastic member may be provided in between the inner periphery and the outer periphery of the diaphragm as a part of the diaphragm. Thereby, a part working as the elastic member may be formed in a part of the diaphragm, and the number of components can be reduced.

Preferably, a change rate of a phase difference between an input signal and a generated sound at the predetermined frequency is lower than that at the lowest resonance frequency. Thereby, the generated sound can be made less prone to deviate from the opposite phase to the noise at around the predetermined frequency, with the result that the noise can be effectively reduced.

A mobile object according to the embodiments of the present invention includes the sound generation device described in any of the above. According to the mobile object of the present invention, a noise in a vehicle interior can be reduced by the sound generation device.

EMBODIMENTS

Hereinafter, embodiments of the present invention will be explained specifically. Incidentally, in embodiments 2 to 7, the components same as the components explained in embodiment 1 and the components having the functions similar to the components explained in the embodiment 1 will be denoted by the same reference signs as the embodiment 1, and the explanations thereof will be omitted.

Embodiment 1

Figure 2:
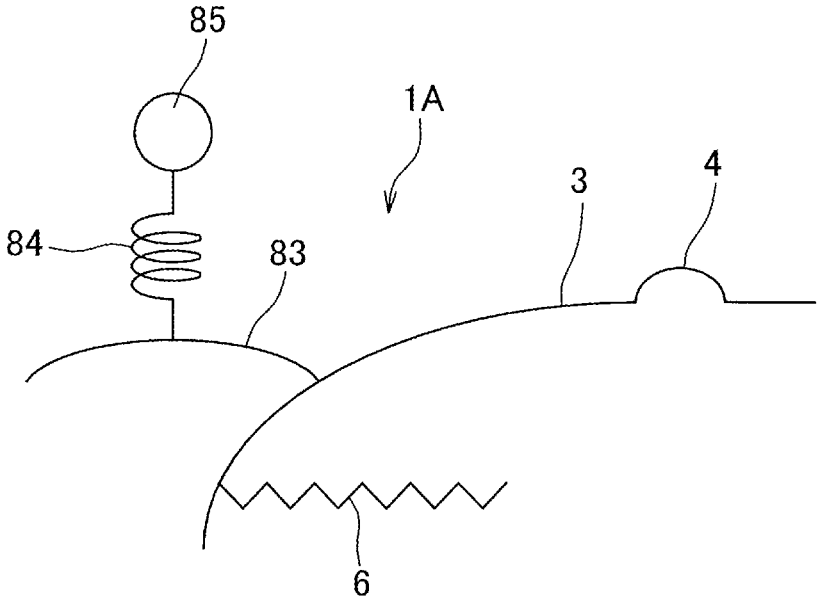
FIG. 2 is a schematic view showing machine elements of the sound generation device.
Figure 3:
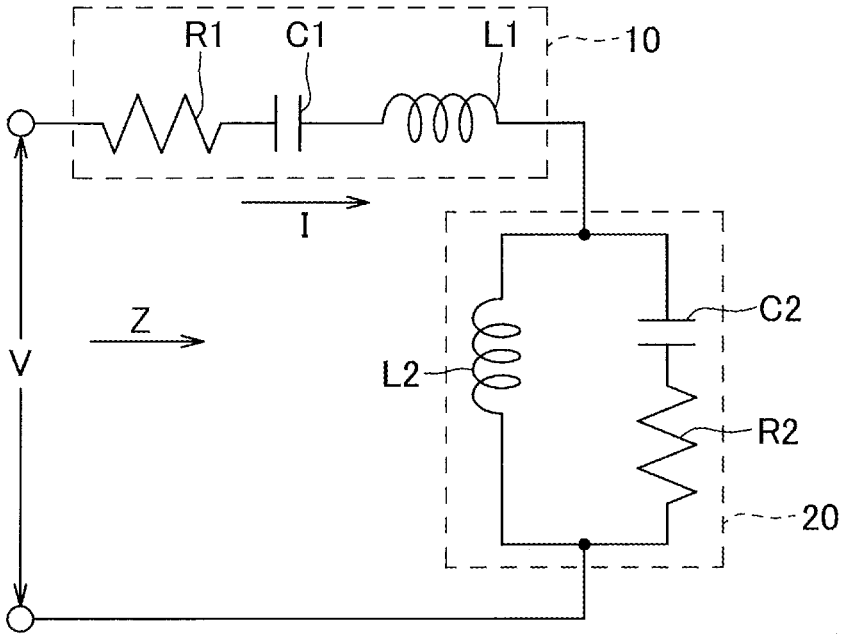
FIG. 3 is an equivalent circuit schematic view replacing the machine elements of the sound generation device with circuit elements.
Figure 4:
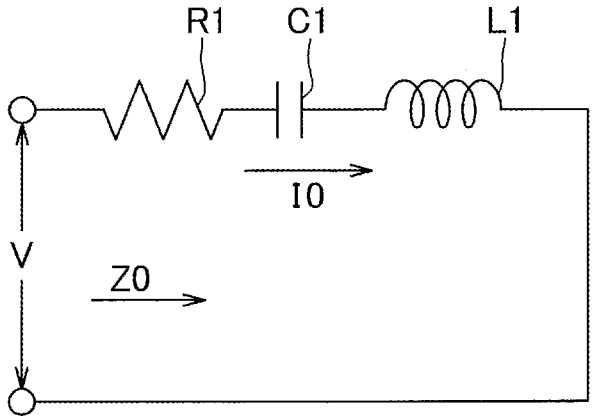
FIG. 4 is an equivalent circuit schematic view replacing the machine elements of a comparison example of the sound generation device with circuit elements.
Figure 5:
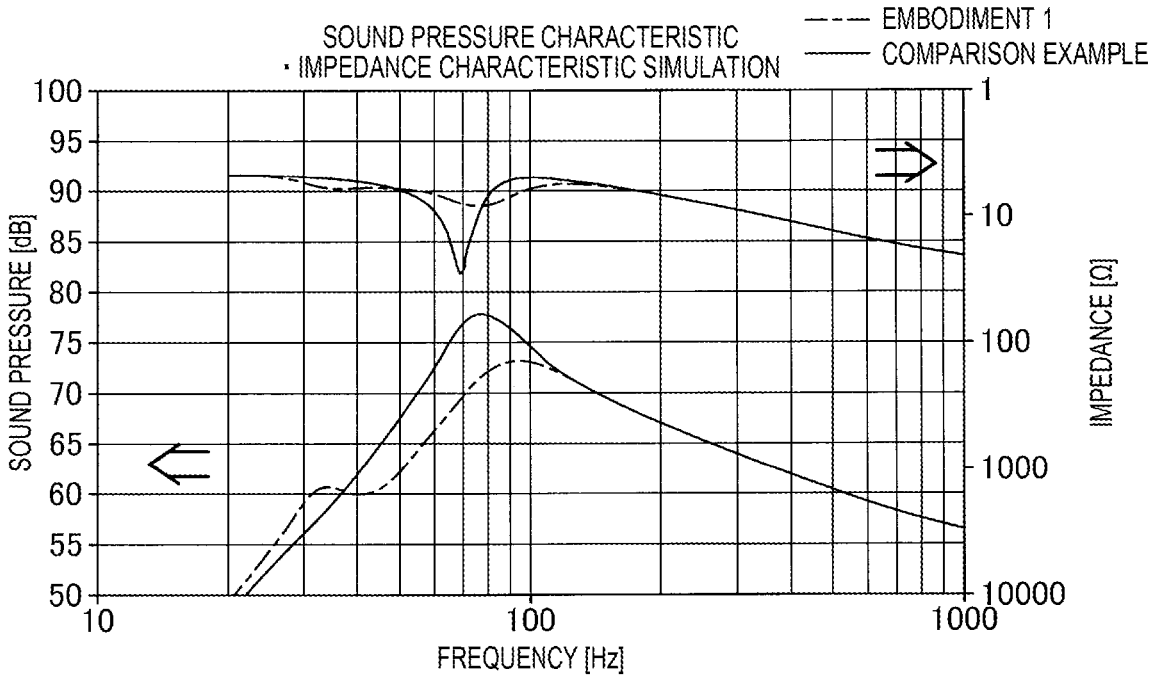
FIG. 5 is a graph showing simulation results of frequency characteristics of impedance and sound pressure in the sound generation devices of the embodiment 1 and the comparison example.
Figure 6:
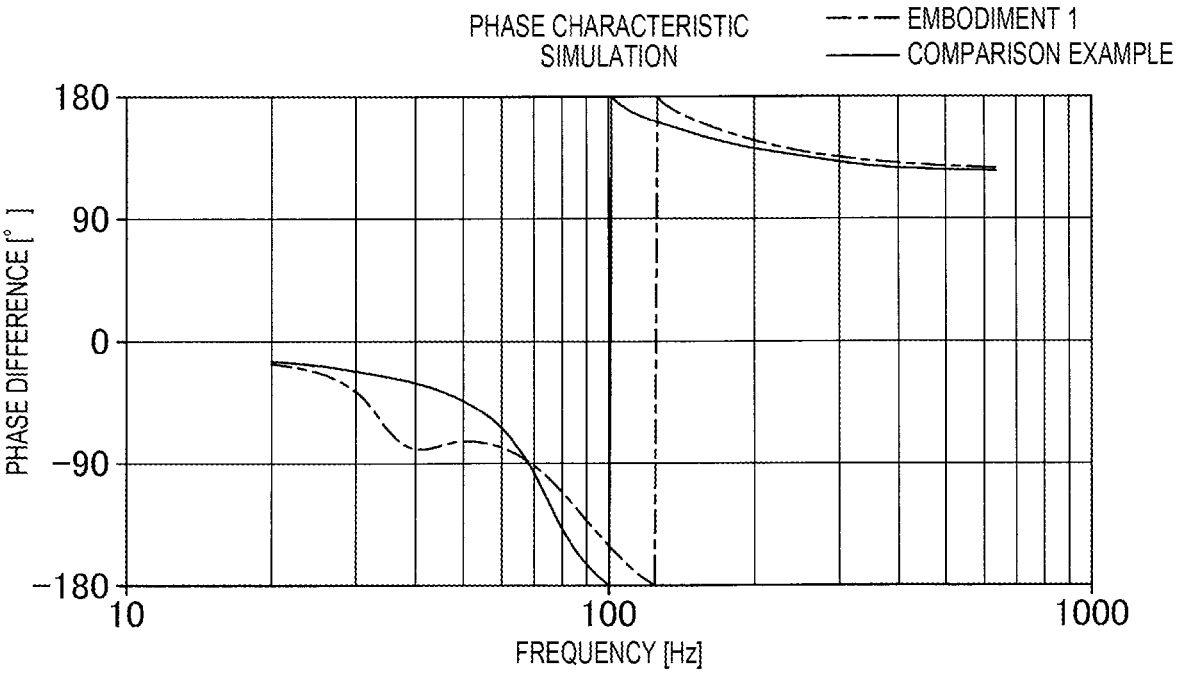
FIG. 6 is a graph showing a simulation result of the phase characteristics in the sound generation devices of the embodiment 1 and the comparison example.
Figure 7:
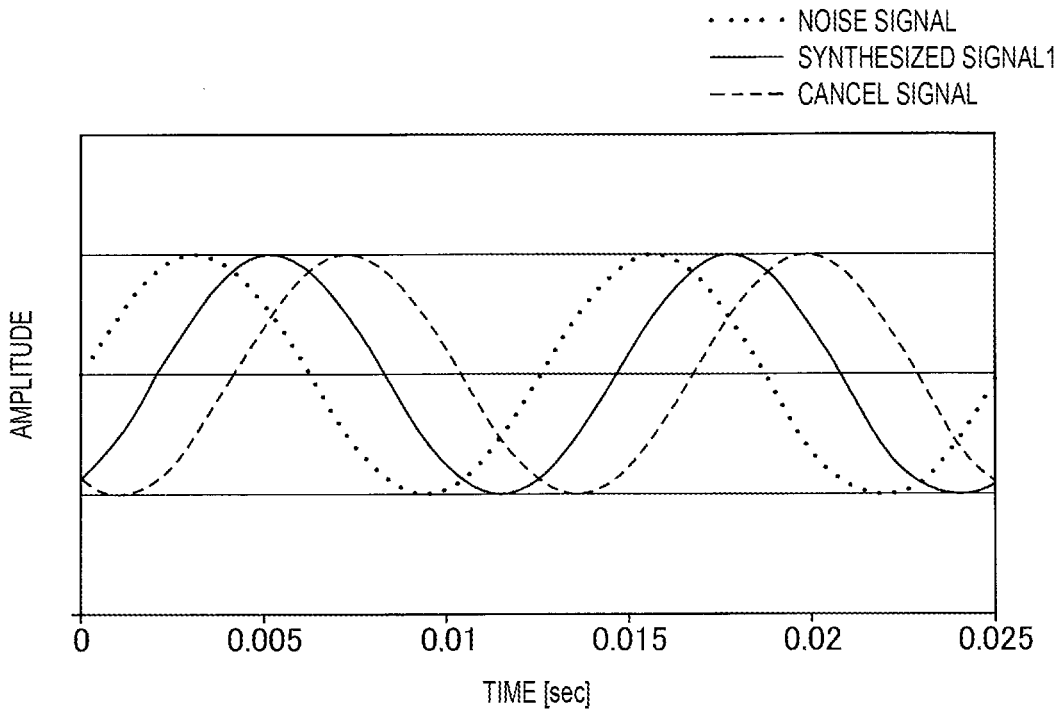
FIG. 7 is a graph showing waves of a noise signal, a cancel signal generated by the sound generation device, and a synthesized signal.

FIG. 1 is a sectional view showing a sound generation device 1A according to an embodiment 1 of the present invention. FIG. 2 is a schematic view showing machine elements of the sound generation device 1A. FIG. 3 is an equivalent circuit schematic view replacing the machine elements of the sound generation device 1A with circuit elements. FIG. 4 is an equivalent circuit schematic view replacing the machine elements of a comparison example of the sound generation device with circuit elements. FIG. 5 is a graph showing simulation results of frequency characteristics of impedance and sound pressure in the sound generation devices of the embodiment 1 and the comparison example. FIG. 6 is a graph showing a frequency dependency of the phase difference between the input signal and the generated signal in the sound generation devices of the embodiment 1 and the comparison example. FIG. 7 is a graph showing waves of a noise signal, a cancel signal generated by the sound generation device, and a synthesized signal.

As shown in FIG. 1, the sound generation device 1A includes: a frame 2; a diaphragm 3 connected to the frame 2; an edge 4 connecting the diaphragm 3 to the frame 2; a tubular voice coil 5 directly connected to the diaphragm 3; a damper 6 connecting the voice coil 5 to the frame 2; a magnetic circuit 7 inserted into an interior of the voice coil 5; and an elastic member 8A connected to the diaphragm 3. Namely, the sound generation device 1A is made of a typical cone-type speaker unit provided with the elastic member 8A. Further, the sound generation device 1A is provided on a vehicle as the mobile object together with an external unit having a sound connection section for collecting the noise, and a transmission section for transmitting the input signal to the voice coil 5. A noise cancel unit is composed of the sound generation device 1A and the external unit.

In an interior of the voice coil 5, the magnet circuit 7 has a projection shape by a magnet 71, a plate 72, and a magnet 73 piled up from bottom to top in FIG. 1.

The elastic member 8A is formed in an annular shape in a plan view by, for example, a rubber. An outer peripheral edge 81 of the elastic member 8A is connected to a sound emission face (in this embodiment, nearer the voice coil 5 than the center) of the diaphragm 3. An inner peripheral edge 82 of the elastic member 8A is a free end, and a weight is connected to an inside of the free end.

In such a sound generation device 1A, when the sound is emitted, the diaphragm 3 and the elastic member 8A are vibrated as follows. In the diaphragm 3, an outer peripheral edge (edge 4 side) is hardly delayed with respect to an inner peripheral side (voice coil 5 side), and the whole diaphragm 3 is integrally vibrated. On the other hand, in the elastic member 8A, the outer peripheral edge 81 is integrally vibrated with the diaphragm 3, but owing to its elasticity, the inner peripheral edge 82 is vibrated with a delay later than the outer peripheral edge 81. In other words, the vibrational wave propagating in the elastic member 8A reaches the inner peripheral edge 82 later than the outer peripheral edge 81. Therefore, a predetermined difference is generated between the phase of the vibrational wave at the inner peripheral edge 82 and the phase of the vibrational wave at the outer peripheral edge 81.

Accordingly, the machine elements in the sound generation device 1A can be schematically shown as FIG. 2. Namely, the elastic member 8A deemed to be composed of a rigid body 83 connected to the diaphragm 3 and a predetermined mass, and a spring 84 connected to the rigid body 83, generating a mechanical resistance upon expansion and contraction and having a predetermined mass. Further, the elastic member 8A is connected to a weight 85. Further, regarding the diaphragm 3, the machine elements are not shown. However, because the diaphragm 3, the damper 6, and the edge 4 have elasticity and mass, they can be deemed to be composed of a spring, a weight, and a mechanical resistance.

When replacing the machine elements as shown in FIG. 2 with electrical circuit elements, there is an electric circuit as shown in FIG. 3. Namely, there is a circuit in which a portion 10 by the diaphragm 3 and a portion 20 by the elastic member 8A are connected in series. In the portion 10 by the diaphragm 3, the resistance R1 by the mechanical resistances of the damper 6 and the edge 4, the capacitor C1 by the compliances of the damper 6 and the edge 4, and the coil L1 by the vibration masses of the diaphragm 3, the damper 6 and the edge 4 are connected in series. Further, in the portion 20 by the elastic member 8A, the capacitor C2 by the compliance of the spring 84 and the resistance R2 by the mechanical resistance of the spring 84 are connected in series, and the coil L2 by the vibration mass of the weight 85 is connected in parallel to the capacitor C2 and the resistance R2.

Here, in the sound generation device of the comparison example in which the elastic member 8A is removed from the sound generation device 1A, similarly when replacing the machine elements with circuit elements, there is an electric circuit as shown in FIG. 4. Namely, there is a circuit in which the resistance R1, the capacitance C1, and the coil L1 are connected in series.

Regarding the impedance-frequency characteristic and the sound pressure-frequency characteristic (sound pressure characteristic) in the sound generation device 1A of the embodiment 1 and the sound generation device of the comparison example, the simulation results based on the above electric circuits are shown in FIG. 5. In FIG. 5, the horizontal axis shows a logarithmic frequency, the left side vertical axis shows the sound pressure, and the right side vertical axis shows the impedance. Further, in FIG. 5, the chain line corresponds to the embodiment 1, and the solid line corresponds to the comparison example.

In the comparison example in which the elastic member is not provided, the maximum impedance value is at about 70 Hz, and is the lowest resonance frequency. By contrast, in the example 1 in which the elastic member 8A is provided, the maximum impedance value is at about 80 Hz, and is the lowest resonance frequency. Further, the local maximum value is at 30 to 40 Hz. Accordingly, the sound pressure of the sound generation device 1A in the embodiment 1 becomes the maximum value at about 90 Hz, and the local maximum value at 30 to 40 Hz. Namely, the sound pressure characteristic has a sub-peak at a predetermined frequency (30 to 40 Hz) on the lower side than the lowest resonance frequency. Therefore, by providing the elastic member, the sub-peak is formed at the predetermined frequency different from the lowest resonance frequency.

Next, the simulation results of the phase characteristics of the sound generation device 1A in the embodiment 1 and the sound generation device in the comparison example are shown in FIG. 6. Incidentally, the phase characteristic means the frequency dependency of the phase difference between the input signal inputted into the voice coil 5 and the generated sound. Further, in FIG. 6, the horizontal axis shows a logarithmic frequency, the vertical axis shows the phase difference (regarding the phase difference lower than −180 degrees, it is redisplayed by adding 360 degrees). Further, in FIG. 6, the chain line corresponds to the embodiment 1, and the solid line corresponds to the comparison example. When the noise signal is detected and the cancel signal is emitted from the sound generation device, if the phase difference is generated between the noise signal and the cancel signal, the cancel effect may be reduced, or the noise may be increased. For example, in a case that the phase difference between the noise signal and the cancel signal is 60 degrees, the waves of the noise signal, the cancel signal having the same amplitude as the noise signal, and the synthesized signal of them are shown in FIG. 7. In a space in which the noise signal and the cancel signal are emitted, the sound pressure of the sound generated in real is amplitude of the synthetic signal. In the example shown in FIG. 7, in a case that the amplitudes of the noise signal and the cancel signal are the same, the amplitudes of the noise signal and the synthetic signal becomes the same. When the phase difference between the noise signal and the cancel signal is over 60 degrees, the cancel effect cannot be obtained.

In the phase characteristic of the sound generation device of the comparison example, the phase difference becomes −90 degrees at the lowest resonance frequency, and as the frequency becomes lower, the phase difference becomes lower. By contrast, in the phase characteristic of the sound generation device of the embodiment 1, the phase difference becomes −100 degrees at the lowest resonance frequency, and as the frequency becomes lower, the phase difference becomes lower. However, the phase difference becomes substantially the constant around the predetermined frequency. Namely, around the predetermined frequency, the change rate of the phase difference of the sound generation device of the embodiment 1 is lower than that of the sound generation device of the comparison example. In the embodiment 1, the phase difference at the predetermined frequency is about −80 degrees. Further, in the embodiment 1, the change rate of the phase difference at the predetermined frequency is about zero, and is lower than the change rate of the phase difference at the lowest resonance frequency.

According to the above configuration, when the phase characteristic is calculated by simulation or actually measured in advance and an input signal is controlled such that the generated sound has an opposite phase to the noise, the generated sound can be made less prone to deviate from the opposite phase to the noise even if a time difference is caused between noise sound collection and sound generation at around the predetermined frequency, with the result that the noise can be effectively reduced. In addition, restrictions regarding the equivalent mass and resonance frequency of a diaphragm 3 can be reduced, the flexibility of design can be improved, and the noise can be reduced in accordance with the predetermined frequency band.

Embodiment 2

Figure 8:
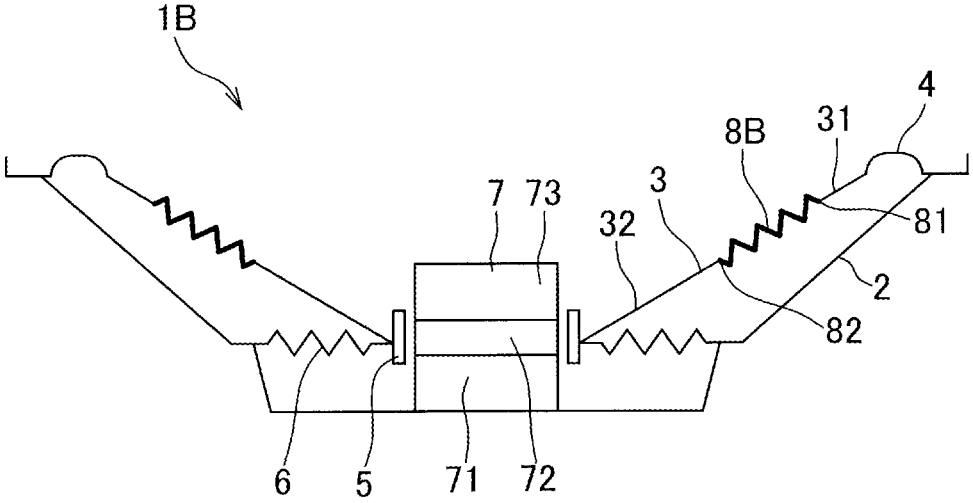
FIG. 8 is a sectional view showing a sound generation device according to an embodiment 2 of the present invention.

FIG. 8 is a sectional view showing a sound generation device 1B according to an embodiment 2 of the present invention. The sound generation device 1B includes: a frame 2; a diaphragm 3; an edge 4; a voice coil 5; a damper 6; a magnetic circuit 7; and an elastic member 8B provided as a part of the diaphragm 3. Namely, the diaphragm 3 has an annular outer peripheral portion 31 connected to the edge 4, and an annular inner peripheral portion 32 separated from the outer peripheral portion 31 and connected to the voice coil 5. The annular elastic member 8B is provided between the outer peripheral portion 31 and the inner peripheral portion 32. An outer edge portion 81 of the elastic member 8B is connected to the outer peripheral portion 31, and an inner edge portion 82 is connected to the inner peripheral portion 32, thereby the diaphragm 3 is integrally formed with the elastic member 8B.

Owing to the above configuration, it is only necessary to form a portion working as the elastic member 8B as a part of the diaphragm 3, and the number of components can be reduced.

Embodiment 3

Figure 9:
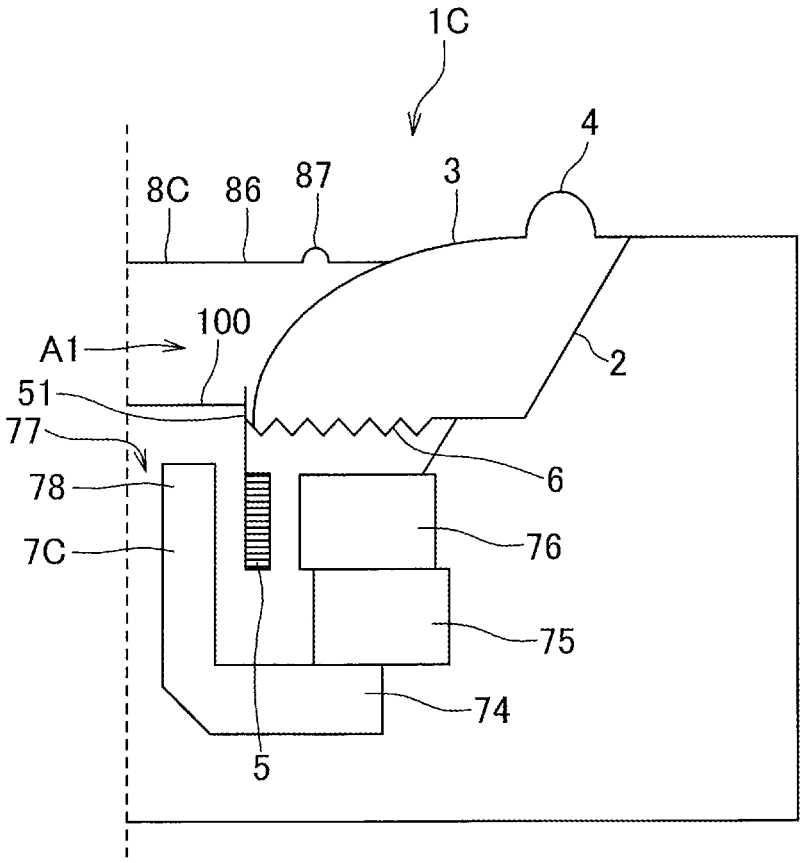
FIG. 9 is a sectional view showing a sound generation device according to an embodiment 3 of the present invention.
Figure 10:
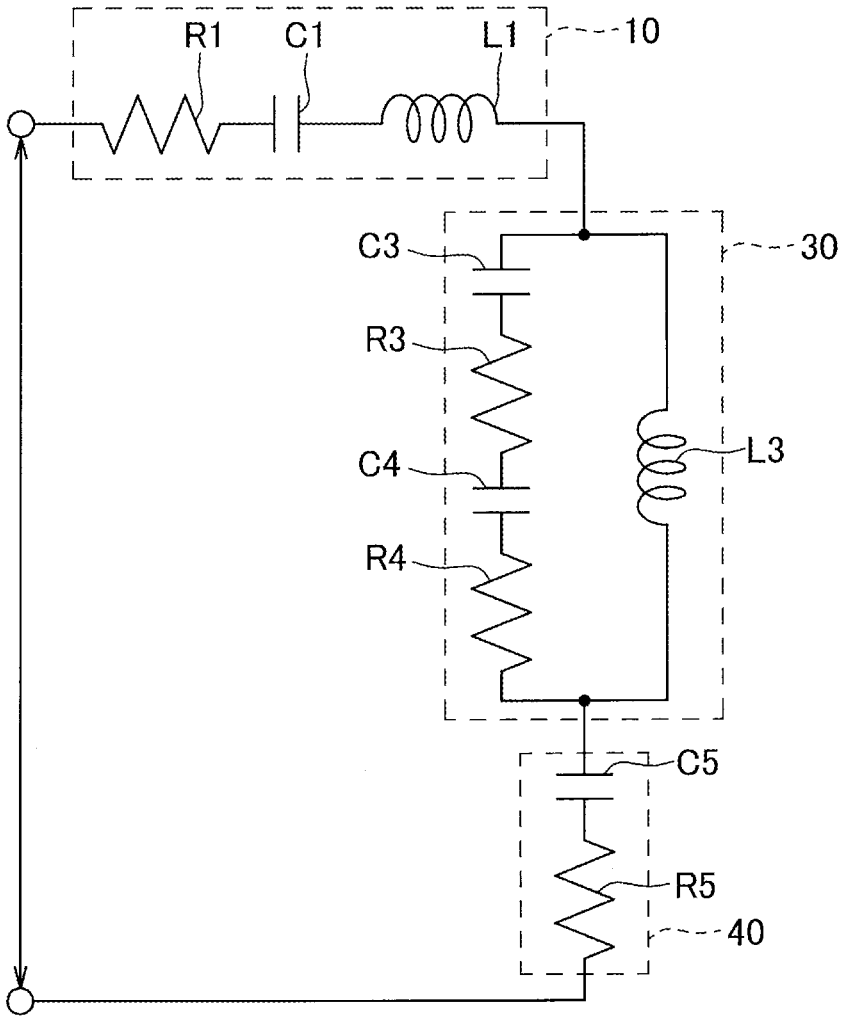
FIG. 10 is an equivalent circuit schematic view replacing the machine elements of the sound generation device of the embodiment 3 with circuit elements.

FIG. 9 is a sectional view showing a sound generation device 1C according to an embodiment 3 of the present invention. FIG. 10 is an equivalent circuit schematic view replacing the machine elements of the sound generation device 1C with circuit elements. Incidentally, in FIG. 9, an illustration of a left side of the sound generation device 1C is omitted. The sound generation device 1C is bilaterally symmetric, and the left side has the similar components to the right side. The sound generation device 1C includes: a frame 2; a diaphragm 3; an edge 4; a voice coil 5; a damper 6; a magnetic circuit 7C; and an elastic member 8C having a closed space A1 thereinside. The elastic member 8C has a shape so as to hide the magnetic circuit 7C from outside. The elastic member 8C includes: a disk-shaped body portion 86; and annular edge portion 87 provided on an outside of the body portion 86. An outer edge at an outside of the edge portion 87 is connected to an intermediate portion (specifically, the center portion) of a sound emission face of the diaphragm 3. The magnetic circuit 7C includes: a yoke 74; a magnet 75 piled up on the yoke 74 at an outside of the voice coil 5; a plate 76 piled up on the magnet 75; and a projection 78 projecting from the yoke 74 and forming a through-hole 77 at an inside of the voice coil 5.

Further, the voice coil 5 is connected to a voice coil support 51, and the voice coil support 51 is connected to the frame 2 via the damper 6. An upper end side of the voice coil support 51 is closed with a cap member 100, and a lower end side is open. By providing the cap member 100 at the upper end side of the voice coil support 51, the closed space A1 is formed in between the cap member 100 and the elastic member 8C. Further, a space in an interior of the voice coil support 51 is communicated with outside via the through-hole 77 formed on the projection 78 of the yoke 74.

When replacing with electrical circuit elements, there is an electric circuit as shown in FIG. 10. Namely, there is a circuit in which a portion 30 by the elastic member 8C and the closed space A1 and the portion 40 by the diaphragm 3 and the closed space A1 are connected in series. In the portion 30 by the elastic member 8C and the closed space A1, the capacitor C3 by the compliance of the edge 87, the resistance R3 by the mechanical resistance of the edge 87, the capacitor C4 by the compliance of the closed space A1 seeing from the body portion 86, and the resistance R4 by the mechanical resistance of the closed space A1 seeing from the body portion 86 are connected in series, and connected in parallel to the coil L3 by the vibration masses of the body portion 86 and the edge 87. In the portion 40 by the diaphragm 3 and the closed space A1, the capacitor 5 by the compliance of the closed space A1 seeing from the diaphragm 3, and the resistance R5 by the mechanical resistances of the closed space A1 seeing from the diaphragm 3 are connected in series.

Figure 11:
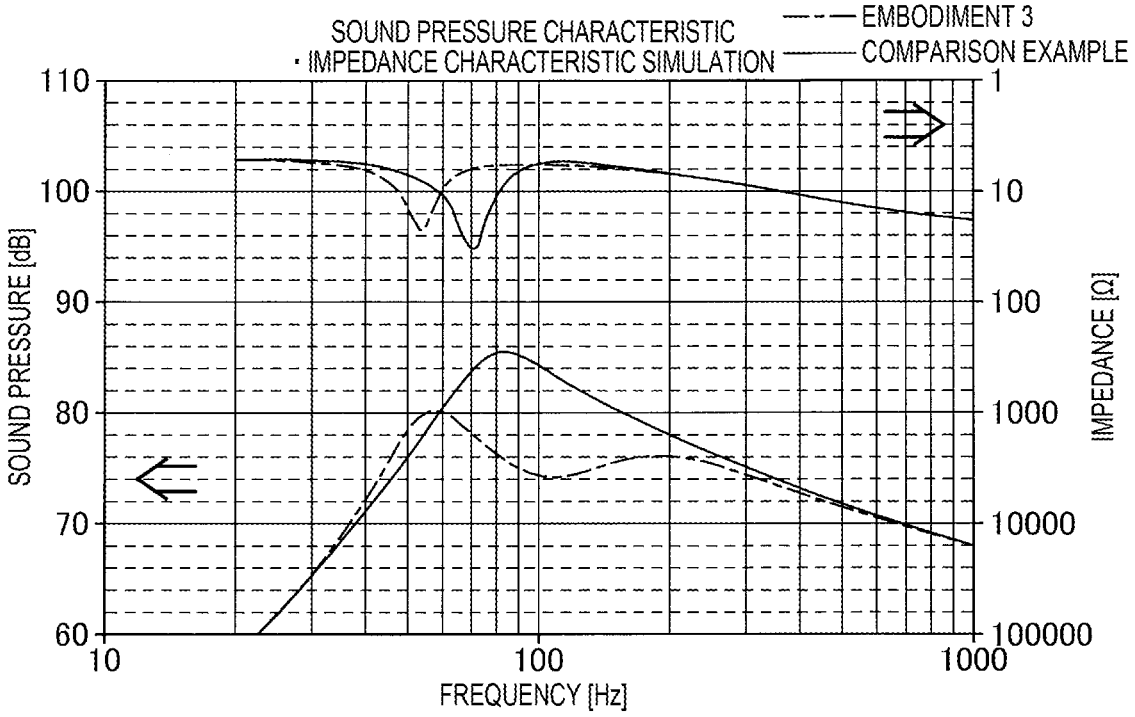
FIG. 11 is a graph showing simulation results of frequency characteristics of impedance and sound pressure in the sound generation devices of the embodiment 3 and the comparison example.
Figure 12:
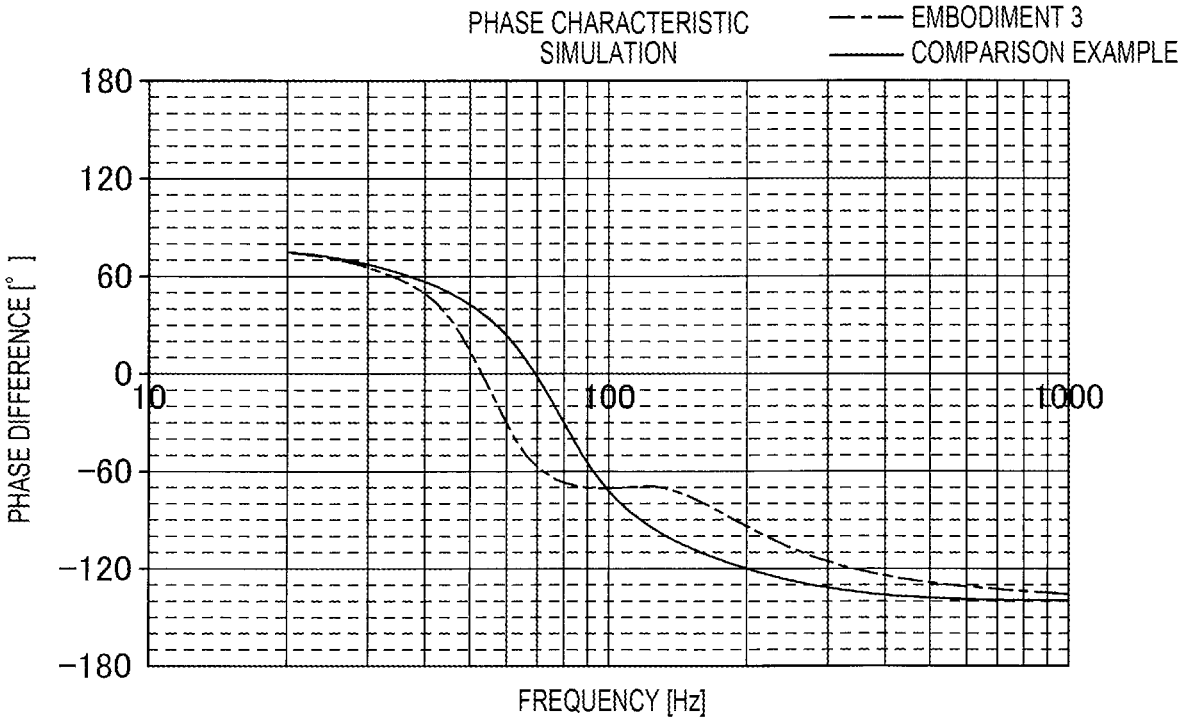
FIG. 12 is a graph showing a simulation result of the phase characteristics in the sound generation devices of the embodiment 3 and the comparison example.

Regarding the impedance-frequency characteristic and the sound pressure-frequency characteristic in the sound generation device 1C of the embodiment 3, a graph based on the above electric circuit is shown in FIG. 11. Similar to the sound generation device 1A of the embodiment 1, in the sound generation device 1C of the embodiment 3, the sub-peak is formed at the predetermined frequency different from the lowest resonance frequency. Further, the phase characteristic of the sound generation device 1C of the embodiment 3 is shown in FIG. 12. Similar to the sound generation device 1A of the embodiment 1, in the sound generation device 1C of the embodiment 3, the change rate becomes lower around the predetermined frequency.

According to the above configuration, by providing the elastic member 8C to form the closed space A1, and by changing the size of the closed space A1, the predetermined frequency can be properly adjusted.

Embodiment 4

Figure 13:
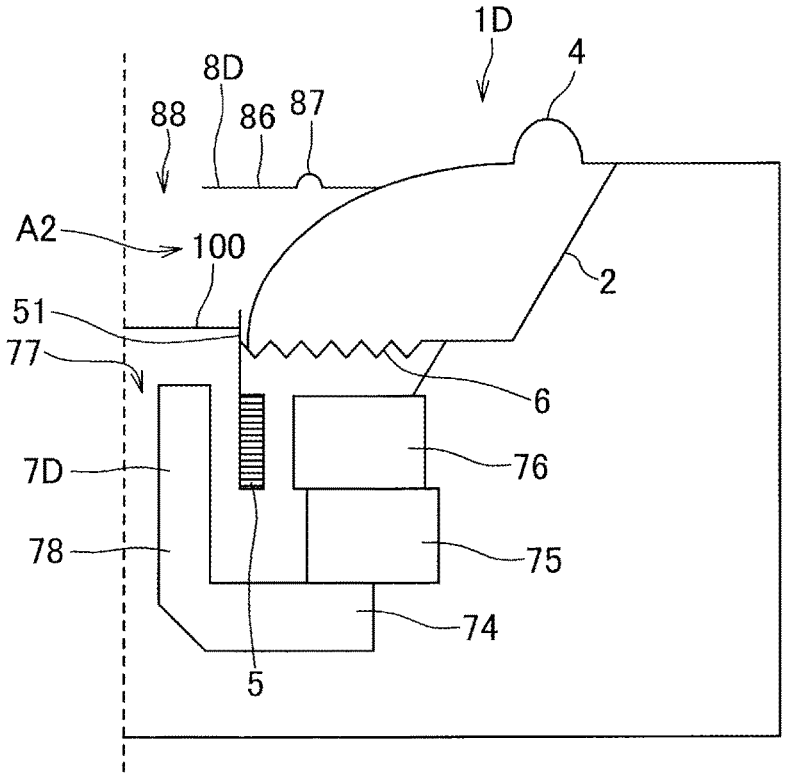
FIG. 13 is a sectional view showing a sound generation device according to an embodiment 4 of the present invention.

FIG. 13 is a sectional view showing a sound generation device 1D according to an embodiment 4 of the present invention. The sound generation device 1D includes: a frame 2; a diaphragm 3; an edge 4; a voice coil 5; a damper 6; a magnetic circuit 7D; and an elastic member 8D. Incidentally, similar to the sound generation device 1C of the embodiment 3 (FIG. 9), the sound generation device 1D is bilaterally symmetric. In FIG. 13, an illustration of a left side of the sound generation device 1D is omitted. The elastic member 8D is made by forming a hole 88 in substantially the center of the body portion 86 of the elastic member 3C of the sound generation device 1C of the embodiment 3. Therefore, by providing the elastic member 8D, a closed space is not formed.

Further, similar to the sound generation device 1C of the embodiment 3, in the sound generation device 1D of the embodiment 4, the voice coil 5 is connected to a voice coil support 51, and the voice coil support 51 is connected to the frame 2 via the damper 6. An upper end side of the voice coil support 51 is closed with a cap member 100, and a lower end side is open. By providing the cap member 100 at the upper end side of the voice coil support 51, a space A2 is formed in between the cap member 100 and the elastic member 8D. The space A2 is communicated with outside via the hole 88. Further, a space within the voice coil support 51 (lower space than the cap member 100) is communicated with outside via the through-hole 77 formed on the projection 78 of the yoke 74.

According to the above configuration, by providing the elastic member 8D to form the space A2, and by changing the size of the space A2, the predetermined frequency can be properly adjusted.

Embodiment 5

Figure 14:
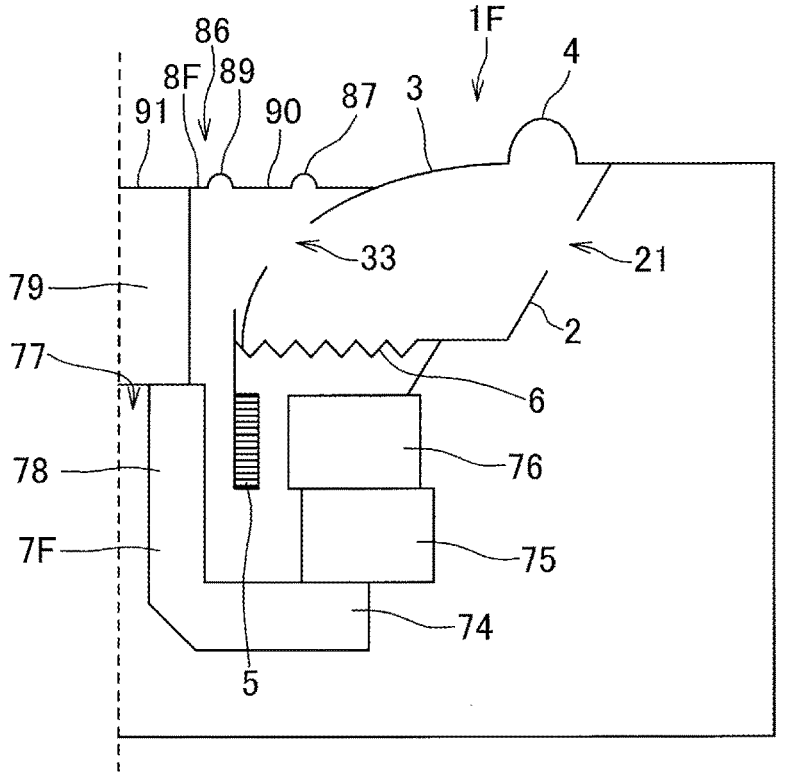
FIG. 14 is a sectional view showing a sound generation device according to an embodiment 5 of the present invention.

FIG. 14 is a sectional view showing a sound generation device 1F according to an embodiment 5 of the present invention. The sound generation device 1F includes: a frame 2; a diaphragm 3; an edge 4; a voice coil 5; a damper 6; a magnetic circuit 7F; and an elastic member 8F. Incidentally, similar to the sound generation device 1C of the embodiment 3 (FIG. 9), the sound generation device 1F is bilaterally symmetric. In FIG. 14, an illustration of a left side of the sound generation device 1F is omitted. The magnetic circuit 7F has an extension portion 79 extending toward a front side of the sound emission direction and connected to the elastic member 8F, in addition to the configurations of the magnetic circuits 7C, 7D of the embodiments 3 and 4. The extension portion 79 may be integrally formed with the projection 78 of the yoke 74 of the magnetic circuit, or may be separated from the projection 78. Further, when the extension portion 79 is not formed integrally with the projection 78, the extension portion 79 may not be made of magnetic material. Further, the voice coil 5 is connected to the voice coil support 51, and the voice coil support 51 is connected to the frame 2 via the damper 6. An upper end side of the through-hole 77 formed on the yoke 74 is closed with the extension portion 79, and a lower end side of the through-hole 77 is open and communicated with outside.

A lower side part of the diaphragm 3 than the elastic member 8F is provided with a hole 33, and the frame 2 is also provided with a hole 21. Therefore, a lower side space of the elastic member 8F is communicated with outside via the holes 33 and 21.

The elastic member 8F is made by forming an edge portion 89 on the body portion 86 of the elastic member 8C in the sound generation device 1C of the embodiment 3. Namely, an outer part of the body portion 86 than the edge portion 86 (a portion held between the two edge portions) is a vibration main portion 90, and an inner part than the edge portion 89 is a fixed portion 91. The extension portion 79 is fixed to a rear face of the fixed portion 91 so as not to vibrate the fixed portion 91.

Embodiment 6

Figure 15:
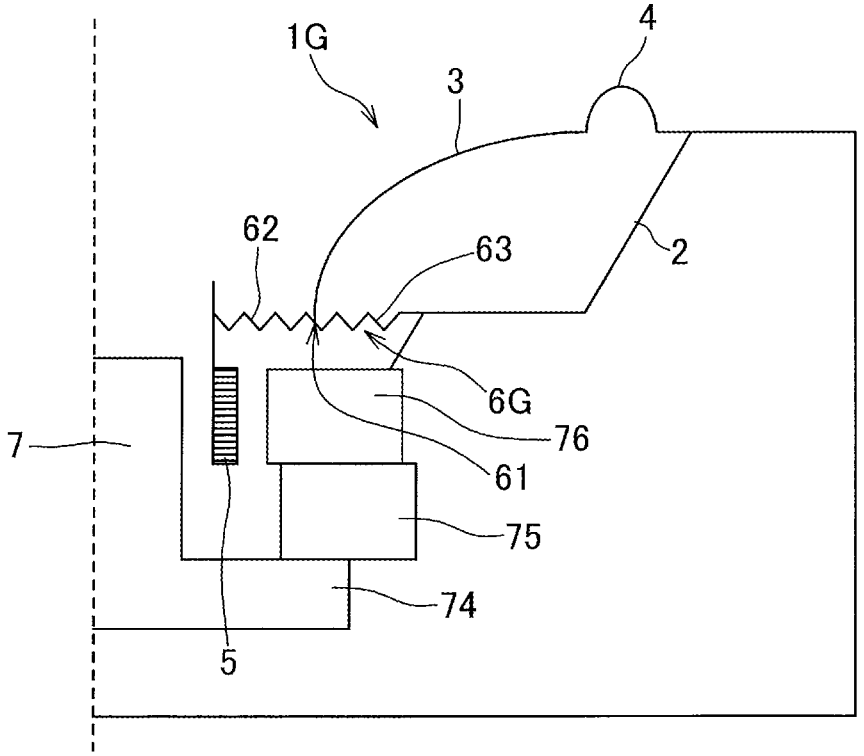
FIG. 15 is a sectional view showing a sound generation device according to an embodiment 6 of the present invention.

FIG. 15 is a sectional view showing a sound generation device 1G according to an embodiment 6 of the present invention. The sound generation device 1G includes: a frame 2; a diaphragm 3; an edge 4; a voice coil 5; a damper 6G; and a magnetic circuit 7. Incidentally, similar to the sound generation device 1C of the embodiment 3 (FIG. 9), the sound generation device 1G is bilaterally symmetric. In FIG. 14, an illustration of a left side of the sound generation device 1F is omitted. The diaphragm 3 is connected to an intermediate portion (specifically, the center portion) of the damper 6G. Namely, the voice coil 5 is indirectly connected to the diaphragm 3 via an inner portion 62 of the damper 6G than a connection portion 61 connected to the diaphragm 3, and the diaphragm 3 is connected to the frame 2 via the outer portion 63 of the damper 6G. Therefore, the inner portion 62 connected to the diaphragm 3 works as the elastic member, and it can be deemed that the elastic member is provided in between the diaphragm 3 and the voice coil 5.

Incidentally, the present invention is not limited to the above embodiments 1 to 6, and includes other configurations that can attain the object of the present invention. For example, modifications indicated as follows are also included in the present invention.

For example, in the above embodiment 1, the absolute value of the phase difference of the generated sound with respect to the input signal at the predetermined frequency is about 80 degrees. However, the phase difference at the predetermined frequency may be set to a proper value. For example, the absolute value of the phase difference at the predetermined frequency may be less than 65 degrees. By setting in this way, in particular, when the sound pressures of the generated sound and of the noise are the same, or when the sound pressure of the noise is smaller than the sound pressure of the generated sound, the amplitude (sound pressure) of the synthetic wave of the generated sound and the noise can be reduced, and the noise can be reduced. The resonance frequency and the predetermined frequency may be sufficiently distant from each other to spread a range where the change rate of the phase difference is low, and in this range, the generated sound can be made less prone to deviate from the opposite phase to the noise.

For example, the phase difference at the lowest resonance frequency (20 Hz) in the phase characteristic shown in FIG. 6 is in between 0 to −90 degrees, but not limited to this, may be in between 0 to 90 degrees, and can be properly set.

Incidentally, the sound generation device according to the embodiments of the present invention can be used as a noise cancel device able to cancel the noise sound in an interior of a mobile object (for example, generated sound while the mobile object is moved).

In addition, the best configuration and the best method for implementing the present invention are disclosed in the above description, however, the present invention is not limited to these. Namely, the present invention is particularly illustrated and explained with respect to the specific embodiment. However, the skilled person could variously modify the shape, the material, the number, and the other detailed configurations with respect to the above described embodiments without departing from scopes of a spirit and an object of the present invention. Therefore, the above disclosed description limiting the shape and the material is illustratively described to facilitate understanding of the present invention, and not to limit the present invention. Therefore, the descriptions of the names of the members removing apart of or all of the limitations such as shapes and materials are included in the present invention.

REFERENCE SIGNS LIST

1A to 1G sound generation device
2 frame
3 diaphragm
4 edge
5 voice coil
8A to 8G elastic member
31 outer periphery
32 inner periphery

The invention claimed is:

1. A sound generation device comprising:
a frame;
a diaphragm connected to the frame;
an edge connecting the diaphragm to the frame;
a voice coil directly or indirectly connected to the diaphragm;
a magnetic member disposed in an interior or an exterior of the voice coil;
a weight; and
an elastic member having an outer periphery connected to the diaphragm and an inner periphery connected to the weight,
wherein a frequency characteristic of a sound pressure of the sound generation device has a sub-peak at a predetermined frequency different from a lowest resonance frequency.

2. The sound generation device as claimed in claim 1, wherein the inner periphery is a free end.

3. The sound generation device as claimed in claim 1, wherein a change rate of a phase difference between an input signal and a generated sound at the predetermined frequency is lower than that at the lowest resonance frequency.

4. The sound generation device as claimed in claim 2, wherein a change rate of a phase difference between an input signal and a generated sound at the predetermined frequency is lower than that at the lowest resonance frequency.

5. A mobile object comprising the sound generation device claimed in claim 1.

6. A mobile object comprising the sound generation device claimed in claim 2.

7. A mobile object comprising the sound generation device claimed in claim 2.

* * * * *